United States Patent [19]

Deverell et al.

[11] 4,456,483

[45] Jun. 26, 1984

[54] FERRITIC STAINLESS STEEL

[75] Inventors: Harry E. Deverell, Natrona Heights; Thomas H. McCunn, Lower Burrell, both of Pa.

[73] Assignee: Allegheny Ludlum Steel Corporation, Pittsburgh, Pa.

[21] Appl. No.: 386,362

[22] Filed: Jun. 8, 1982

Related U.S. Application Data

[63] Continuation of Ser. No. 109,363, Jan. 3, 1980, abandoned.

[51] Int. Cl.[3] ..... C22C 38/40

[52] U.S. Cl. ..... 75/128 N; 75/128 Z; 75/128 T; 75/128 G; 428/685

[58] Field of Search ..... 75/128 A, 128 C, 128 N, 75/128 G, 128 Z, 128 T, 128 W; 428/683, 685, 684

[56] References Cited

U.S. PATENT DOCUMENTS 4,155,752 5/1979 Oppenheim ..... 75/128 N 4,216,013 8/1980 Gemmel et al. ..... 75/128 N 4,255,497 3/1981 Bond et al. ..... 75/128 T

*Primary Examiner*—L. Dewayne Rutledge

*Assistant Examiner*—Debbie Yee

*Attorney, Agent, or Firm*—Patrick J. Viccaro

[57] ABSTRACT

A ferritic stainless steel characterized by superior toughness both prior to and after welding, and by superior crevice and integranular corrosion resistance. The steel consists essentially of, by weight, up to 0.08% carbon, up to 0.06% nitrogen, from 25.00 to 35.00% chromium, from 3.60 to 5.60% molybdenum, up to 2.00% manganese, between 2.00 and 5.00% nickel, up to 2.00% silicon, up to 0.5% aluminum, up to 2.00% of elements from the group consisting of titanium, zirconium and columbium, balance essentially iron. The sum of carbon plus nitrogen is in excess of 0.0275%. Titanium, zirconium and columbium are in accordance with the following equation:

$$\%Ti/6+\%Zr/7+\%Cb/8 \geqq \%C+\%N$$

9 Claims, No Drawings

FERRITIC STAINLESS STEEL

This is a continuation of application Ser. No. 109,363, filed Jan. 3, 1980, now abandoned.

The present invention relates to a ferritic stainless steel.

United States Patent Application Ser. No. 109,373, filed concurrently herewith, describes a ferritic stainless steel which is characterized by superior crevice and intergranular corrosion resistance.

The steel of Application Ser. No. 109,373 is distinguishable from that of U.S. Pat. Nos. 3,932,174 and 3,929,473 in that it has up to 2% of elements from the group consisting of titanium, zirconium and columbium in accordance with the following equation:

$$\%Ti/6+\%Zr/7+\%Cb/8 \geqq \%C+\%N$$

and a carbon plus nitrogen content in excess of 275 parts per million. Because of its higher carbon and nitrogen content, it can be melted and refined by less costly procedures than can the steels of U.S. Pat. Nos. 3,932,174 and 3,929,473.

Through the present invention, there is provided a steel which is tougher than that of Application Ser. No. 109,373. In addition to stabilizers from the group consisting of titanium, zirconium and columbium and a carbon plus nitrogen content in excess of 275 parts per million; the steel of the present invention has between 2.00 and 5.00% nickel, and preferably between 3.00 and 4.50%, whereas the steel of Application Ser. No. 109,373 has up to 2.00% and usually less than 1.00% nickel. Nickel has been found to enhance the toughness of the alloy of Application Ser. No. 109,373.

For the reasons noted hereinabove, the alloy of the present invention is clearly distinguishable from that of U.S. Pat. Nos. 3,932,174 and 3,929,473. It is also distinguishable from that of U.S. Pat. No. 4,119,765. The alloy of U.S. Pat. No. 4,119,765 specifies a maximum molybdenum content below that for the present invention.

Another reference of interest is a paper entitled, "Ferritic Stainless Steel Corrosion Resistance and Economy". The paper was written by Remus A. Lula and appeared in the July 1976 issue of Metal Progress, pages 24–29. It does not disclose the ferritic stainless steel of the present invention.

It is accordingly an object of the present invention to provide a ferritic stainless steel.

The ferritic stainless steel of the present invention is characterized by superior toughness both prior to and after welding, by superior crevice and intergranular corrosion resistance and by good weldability. It consists essentially of, by weight, up to 0.08% carbon, up to 0.06% nitrogen, from 25.00 to 35.00% chromium, from 3.60 to 5.60% molybdenum, up to 2.00% manganese, between 2.00 and 5.00% nickel, up to 2.00% silicon, up to 0.5% aluminum, up to 2.00% of elements from the group consisting of titanium, zirconium and columbium, balance essentially iron. The sum of carbon plus nitrogen is in excess of 0.0275%. Titanium, zirconium and columbium are in accordance with the following equation:

$$\%Ti/6+\%Zr/7+\%Cb/8 \geqq \%C+\%N$$

Carbon and nitrogen are usually present in respective amounts of at least 0.005% and 0.010%, with the sum being in excess of 0.0300%. Chromium and molybdenum are preferably present in respective amounts of 28.50 to 30.50% and 3.75 to 4.75%. Manganese and silicon are each usually present in amounts of less than 1.00%. Aluminum which may be present for its effect as a deoxidizer is usually present in amounts of less than 0.1%.

Titanium, columbium and/or zirconium are added to improve the crevice and intergranular corrosion resistance of the alloy, which in a sense is a high carbon plus nitrogen version of U.S. Pat. No. 3,929,473. It has been determined, that stabilizers can be added to high carbon and/or nitrogen versions of U.S. Pat. No. 3,929,473, without destroying the toughness and/or weldability of the alloy. Although it is preferred to add at least 0.15% of titanium, insofar as the sole presence of columbium can adversely affect the weldability of the alloy, it is within the scope of the present invention to add the required amount of stabilizer as either titanium or columbium. Columbium has a beneficial effect, in comparison with titanium, on the toughness of the alloy. A particular embodiment of the invention calls for at least 0.15% columbium and at least 0.15% titanium. Titanium, columbium and zirconium are preferably present in amounts up to 1.00% in accordance with the following equation:

$$\%Ti/6+\%Zr/7+\%Cb/8=1.0 \text{ to } 4.0\ (\%C+\%N)$$

Nickel is added to the alloy of the present invention to enhance its toughness. It is added in amounts between 2.00 and 5.00%, and preferably in amounts between 3.00 and 4.50%.

The ferritic stainless steel of the present invention is particularly suitable for use as a welded article.

The following examples are illustrative of several aspects of the invention.

Ingots from twenty-four heats (Heats A through X) were heated to 2050° F., hot rolled to 0.125 inch strip, annealed at temperatures of 1950° or 2050° F., cold rolled to about 0.062 inch strip and annealed at temperatures of 1950° or 2050° F. Hot rolled and cold rolled specimens were subsequently evaluated for toughness. Other specimens were TIG welded and then evaluated for toughness.

The chemistry of the heats appears hereinbelow in Table I.

TABLE I

| | COMPOSITION (wt. %) | | | | | | | | | | |
|---|---|---|---|---|---|---|---|---|---|---|---|
| Heat | C | N | Cr | Mo | Mn | Ni | Si | Al | Ti | Cb | Fe |
| A | 0.030 | 0.025 | 28.96 | 4.20 | 0.34 | 0.45 | 0.36 | 0.029 | 0.50 | — | Bal. |
| B | 0.030 | 0.026 | 29.05 | 4.18 | 0.34 | 0.46 | 0.37 | 0.029 | 0.20 | 0.32 | Bal. |
| C | 0.031 | 0.025 | 28.96 | 4.06 | 0.36 | 0.45 | 0.29 | 0.027 | 0.09 | 0.45 | Bal. |
| D | 0.034 | 0.027 | 28.95 | 4.20 | 0.43 | 0.46 | 0.37 | 0.040 | 0.19 | 0.41 | Bal. |
| E | 0.035 | 0.026 | 28.75 | 4.20 | 0.40 | 0.47 | 0.45 | 0.025 | 0.20 | 0.42 | Bal. |
| F | 0.032 | 0.024 | 29.52 | 4.10 | 0.37 | 0.51 | 0.28 | 0.030 | 0.31 | 0.44 | Bal. |
| G | 0.013 | 0.018 | 29.00 | 4.00 | 0.35 | 4.00 | 0.37 | 0.023 | 0.31 | — | Bal. |

TABLE I-continued

| Heat | COMPOSITION (wt. %) C | N | Cr | Mo | Mn | Ni | Si | Al | Ti | Cb | Fe |
|---|---|---|---|---|---|---|---|---|---|---|---|
| H | 0.027 | 0.018 | 29.00 | 4.00 | 0.35 | 4.15 | 0.36 | 0.026 | 0.31 | — | Bal. |
| I | 0.029 | 0.018 | 29.00 | 4.00 | 0.35 | 4.16 | 0.36 | 0.029 | 0.60 | — | Bal. |
| J | 0.025 | 0.020 | 28.74 | 3.90 | 0.35 | 4.00 | 0.36 | 0.037 | — | 0.37 | Bal. |
| K | 0.034 | 0.016 | 29.10 | 4.00 | 0.36 | 4.10 | 0.38 | 0.010 | — | 0.52 | Bal. |
| L | 0.032 | 0.018 | 29.10 | 4.00 | 0.35 | 4.10 | 0.39 | 0.014 | 0.20 | 0.38 | Bal. |
| M | 0.018 | 0.025 | 29.23 | 4.04 | 0.32 | 3.00 | 0.34 | 0.050 | 0.11 | 0.29 | Bal. |
| N | 0.021 | 0.021 | 29.08 | 4.05 | 0.32 | 3.01 | 0.34 | 0.046 | 0.20 | 0.28 | Bal. |
| O | 0.019 | 0.023 | 28.95 | 4.10 | 0.32 | 3.00 | 0.35 | 0.021 | 0.10 | 0.42 | Bal. |
| P | 0.021 | 0.024 | 28.81 | 4.10 | 0.31 | 3.05 | 0.34 | 0.043 | 0.20 | 0.42 | Bal. |
| Q | 0.022 | 0.020 | 29.47 | 4.04 | 0.33 | 3.03 | 0.32 | 0.017 | — | 0.43 | Bal. |
| R | 0.020 | 0.023 | 29.20 | 4.04 | 0.33 | 3.03 | 0.31 | 0.040 | — | 0.64 | Bal. |
| S | 0.025 | 0.023 | 28.94 | 3.91 | 0.34 | 3.91 | 0.34 | 0.051 | 0.12 | 0.29 | Bal. |
| T | 0.020 | 0.020 | 29.23 | 4.03 | 0.33 | 4.18 | 0.33 | 0.046 | 0.20 | 0.28 | Bal. |
| U | 0.017 | 0.020 | 29.15 | 4.04 | 0.30 | 4.00 | 0.28 | 0.055 | 0.12 | 0.43 | Bal. |
| V | 0.018 | 0.022 | 29.10 | 4.04 | 0.30 | 4.00 | 0.28 | 0.021 | 0.18 | 0.43 | Bal. |
| W | 0.022 | 0.021 | 28.94 | 3.94 | 0.33 | 4.08 | 0.35 | 0.037 | — | 0.44 | Bal. |
| X | 0.024 | 0.022 | 28.96 | 3.93 | 0.33 | 4.10 | 0.32 | 0.040 | — | 0.64 | Bal. |

Note that Heats A through F are outside the subject invention. They do not have a nickel content between 2.00 and 5.00%. The present invention is dependent upon a nickel content in excess of 2.00%.

Additional data pertaining to the chemistry of the heats appears hereinbelow in Table II.

TABLE II

| Heat | % C + % N | % Ti/6 + % Zr/7 + % Cb/8 |
|---|---|---|
| A | 0.055 | 0.083 |
| B | 0.056 | 0.073 |
| C | 0.056 | 0.071 |
| D | 0.061 | 0.083 |
| E | 0.061 | 0.086 |
| F | 0.056 | 0.107 |
| G | 0.031 | 0.052 |
| H | 0.045 | 0.052 |
| I | 0.047 | 0.100 |
| J | 0.045 | 0.046 |
| K | 0.050 | 0.065 |
| L | 0.050 | 0.081 |
| M | 0.043 | 0.054 |
| N | 0.042 | 0.068 |
| O | 0.042 | 0.069 |
| P | 0.045 | 0.086 |
| Q | 0.042 | 0.054 |
| R | 0.043 | 0.080 |
| S | 0.048 | 0.056 |
| T | 0.040 | 0.068 |
| U | 0.037 | 0.074 |
| V | 0.040 | 0.084 |
| W | 0.043 | 0.055 |
| X | 0.046 | 0.080 |

Toughness was evaluated by determining the transition temperature using subsize transverse Charpy V-notch specimens for hot rolled and annealed material (0.125×0.394 inch specimens), cold rolled and annealed material (0.062×0.394 inch specimens), as welded material (0.062×0.394 inch specimens) and welded and annealed material (0.062×0.394 inch specimens). Transition temperature was based upon a 50% ductile-50% brittle fracture appearance. The transition temperatures for the hot rolled and cold rolled specimens appears hereinbelow in Table III. Heats A through L were annealed at 1950° F. The other heats were annealed at 2050° F.

TABLE III

| Heat | TRANSITION TEMPERATURE (°F.) Hot Rolled and Annealed: Water Quenched | Hot Rolled and Annealed: Air Cooled | Cold Rolled and Annealed: Water Quenched | Cold Rolled and Annealed: Air Cooled |
|---|---|---|---|---|
| A | 130 | 300 | 35 | 115 |
| B | 120 | 260 | −20 | 65 |
| C | 110 | 230 | 10 | 50 |
| D | 135 | 320 | 40 | 85 |
| E | 140 | 320 | 10 | 85 |
| F | 210 | 210 | 40 | 90 |
| G | −35 | — | −180 | −100 |
| H | −46 | — | −175 | −100 |
| I | 5 | — | −180 | −90 |
| J | −120 | — | −190 | −170 |
| K | −70 | — | −200 | −105 |
| L | −40 | — | −175 | −130 |
| M | 50 | 100 | −130 | — |
| N | 35 | 65 | −120 | — |
| O | 5 | 55 | −125 | — |
| P | 30 | 70 | −135 | — |
| Q | −35 | 60 | −150 | — |
| R | 15 | 60 | −165 | — |
| S | −35 | 15 | −185 | — |
| T | −25 | 15 | −180 | — |
| U | −65 | −10 | −175 | — |
| V | −70 | −25 | −180 | — |
| W | −90 | −25 | −200 | — |
| X | −100 | −25 | −225 | — |

The transition temperatures for the as welded and welded and annealed specimens appears hereinbelow in Table IV. Heats A through F were annealed at 1950° F. prior to welding. The other heats were annealed at 2050° F. All heats were water quenched. Post weld anneals were at 1950° F. for Heats A through F and at 2050° F. for the other heats. All heats were water quenched after the post weld anneal.

TABLE IV

| Heat | TRANSITION TEMPERATURE (°F.) As Welded | Welded And Annealed |
|---|---|---|
| A | 110 | 30 |
| B | 60 | 35 |
| C | 90 | 40 |
| D | 105 | 25 |
| E | 155 | 40 |
| F | 130 | 50 |
| G | −105 | −105 |
| H | −80 | −95 |
| I | −45 | −95 |
| J | −110 | −215 |
| K | −90 | −155 |
| L | −60 | −120 |
| M | −60 | −65 |

TABLE IV-continued

| Heat | TRANSITION TEMPERATURE (°F.) As Welded | Welded And Annealed |
|---|---|---|
| N | 0 | −40 |
| O | −20 | −85 |
| P | −10 | −75 |
| Q | −60 | −110 |
| R | −20 | −75 |
| S | −40 | −135 |
| T | −60 | −100 |
| U | −110 | −115 |
| V | −115 | −120 |
| W | −100 | −160 |
| X | −140 | −200 |

The benefit of nickel is clearly evident from Tables III and IV. Heats G through X have substantially lower transition temperatures, and are therefore substantially tougher than are Heats A through F. Significantly, Heats G through X are within the present invention whereas Heats A through F are not. Heats G through X having in excess of 2.00% nickel.

The lower transition temperatures for Heats G through X is exemplified hereinbelow in Table V which is a composite of Tables III and IV.

TABLE V

| | TRANSITION TEMPERATURE (°F.) Heats A–F | Heats G–X |
|---|---|---|
| Hot Rolled and Annealed (Water Quenched) | 110 to 210 | −120 to 50 |
| Hot Rolled and Annealed (Air Cooled) | 210 to 320 | −25 to 100 |
| Cold Rolled and Annealed (Water Quenched) | −20 to 40 | −225 to −120 |
| Cold Rolled and Annealed (Air Cooled) | 50 to 115 | −170 to −90 |
| As Welded | 60 to 155 | −140 to 0 |
| Welded and Annealed | 25 to 50 | −215 to −40 |

Note that in every instance the maximum transition temperature for Heats G through X is lower than the minimum transition temperature for Heats A through F. The data clearly shows that Heats G through X are tougher than are Heats A through F.

Additional specimens of Heats G through X were evaluated for crevice and intergranular corrosion resistance. These specimens were prepared as were the specimens referred to hereinabove.

Crevice corrosion resistance was evaluated by immersing 1 inch by 2 inch surface ground specimens in a 10% ferric chloride solution for 72 hours. Testing was performed at a temperature of 122° F. Crevices were created by employing polytetrafluoroethylene blocks on the front and back, held in position by pairs of rubber bands stretched at 90° F. to one another in both longitudinal and transverse directions. The test is described in Designation: G 48-76 of the American Society for Testing And Materials.

The results of the evaluation appear hereinbelow in Table VI. Specimens were in the cold rolled and annealed condition, in the as welded condition and in the as welded and annealed condition.

TABLE VI

| Heat | 10% FERRIC CHLORIDE CREVICE CORROSION TEST WEIGHT LOSS (GRAMS) Cold Rolled and Annealed | As Welded | Welded and Annealed* |
|---|---|---|---|
| G | — | 0.0001 | 0.0008 |
| H | — | 0.1588 | 0.0005 |
| I | — | 0.0 | 0.0004 |
| J | — | 0.0 | 0.0001 |
| K | — | 0.0 | 0.0015 |
| L | — | 0.0001 | 0.0001 |
| M | 0.0 | 0.0004 | 0.0003 |
| N | 0.0009 | 0.0027 | 0.0009 |
| O | 0.0 | 0.0007 | 0.0001 |
| P | 0.0001 | 0.0004 | 0.0004 |
| Q | 0.0 | 0.0005 | 0.0039 |
| R | 0.0007 | 0.0032 | 0.0068 |
| S | 0.0056 | 0.0007 | 0.0 |
| T | 0.0 | 0.0001 | 0.0056 |
| U | 0.0002 | 0.0001 | 0.0 |
| V | 0.0001 | 0.0078 | 0.0002 |
| W | 0.0001 | 0.0 | 0.0063 |
| X | 0.0 | 0.0003 | 0.0060 |

*Annealed at 2050° F. - Water Quenched

From Table VI, it is noted that the crevice corrosion resistance of Heats G through X is excellent. The alloy of the present invention is indeed characterized by superior crevice corrosion resistance.

Intergranular corrosion resistance was evaluated by immersing 1 inch by 2 inch surface ground specimens in a boiling cupric sulfate-50% sulfuric acid solution for 120 hours. The usual pass-fail criteria for this test are a corrosion rate of 24.0 mils per year (0.0020 inches per month) and a satisfactory microscopic examination. This test is recommended for stabilized high chromium ferritic stainless steels.

The results of the evaluation appear hereinbelow in Table VII. Specimens were in the as welded condition and in the as welded and annealed condition.

TABLE VII

| Heat | CUPRIC SULFATE - 50% SULFURIC ACID CORROSION TEST: CORROSION RATE (inches per month) As Welded | Welded and Annealed* | MICROSCOPIC EXAMINATION (at 30×) As Welded | Welded and Annealed* |
|---|---|---|---|---|
| G | 0.000495 | 0.000633 | NA** | NA |
| H | 0.000646 | 0.000582 | NA | NA |
| I | 0.000508 | 0.000676 | NA | NA |
| J | 0.000435 | 0.000631 | NA | NA |
| K | 0.000368 | 0.000735 | NA | NA |
| L | 0.000378 | 0.000595 | NA | NA |
| S | 0.000501 | 0.000622 | NA | NA |
| T | 0.000469 | 0.000498 | NA | NA |
| U | 0.000401 | 0.000631 | NA | NA |
| V | 0.000481 | 0.000485 | NA | NA |
| W | 0.000481 | 0.000505 | NA | NA |
| X | 0.000508 | 0.000545 | NA | NA |

*Annealed at 2050° F. - Water Quenched
**NA: NO INTERGRANULAR ATTACK OR GRAIN DROPPING From Table VII, it is noted that Heats G through L and S through X exhibit superior intergranular corrosion resistance. Each specimen passed the test.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

We claim:

1. A crevice corrosion-resistant tough, weldable ferritic stainless steel consisting essentially of, by weight, up to 0.08% carbon, up to 0.06% nitrogen, from 28.5 to 30.5% chromium, from 3.60 to 5.60% molybdenum, up to 2.00% manganese, between 2.00 and 5.00% nickel, up to 2.00% silicon, up to 0.5% aluminum for deoxidizing the steel, up to 2.00% of elements from the group consisting of titanium, zirconium and columbium, balance essentially iron; said titanium, zirconium and columbium being in accordance with the following equation:

$$\%Ti/6+\%Zr/7+\%Cb/8 \geqq \%C+N$$

the sum of said carbon plus said nitrogen being in excess of 0.0275%; said steel being characterized by its as-welded crevice corrosion resistance at 50° C. (122° F.).

2. A ferritic stainless steel according to claim 1, having between 3.00 and 4.50% nickel.

3. A ferritic stainless steel according to claim 1, having at least 0.005% carbon and at least 0.010% nitrogen, the sum of said carbon plus said nitrogen being in excess of 0.0300%.

4. A ferritic stainless steel according to claim 1, having from 3.75 to 4.75% molybdenum.

5. A ferritic stainless steel according to claim 1, having up to 1.00% of elements from the group consisting of titanium, zirconium and columbium in accordance with the following equation:

$$\%Ti/6+\%Zr/7+\%Cb/8=1.0 \text{ to } 4.0\ (\%C+\%N).$$

6. A ferritic stainless steel according to claim 1, having at least 0.15% titanium.

7. A ferritic stainless steel according to claim 6, having at least 0.15% columbium.

8. A ferritic stainless steel according to claim 1, having at least 0.005% carbon, at least 0.010% nitrogen, from 28.50 to 30.50% chromium, from 3.75 to 4.75% molybdenum, between 3.00 and 4.50% nickel, up to 0.1% aluminum and up to 1.00% of elements from the group consisting of titanium, zirconium and columbium in accordance with the following equation:

$$\%Ti/6+\%Zr/7+\%Cb/8=1.0 \text{ to } 4.0\ (\%C+\%N)$$

the sum of said carbon plus said nitrogen being in excess of 0.0300%.

9. A welded article made of the steel of claim 1.

* * * * *